United States Patent [19]

Numbers

[11] 4,084,326

[45] Apr. 18, 1978

[54] GUN SIGHT

[76] Inventor: Jody L. Numbers, 7908 E. Oak, Scottsdale, Ariz. 85257

[21] Appl. No.: 700,385

[22] Filed: Jun. 28, 1976

[51] Int. Cl.[2] ..... F41G 1/38

[52] U.S. Cl. ..... 33/245; 350/10; 356/254

[58] Field of Search ..... 33/245, 246, 247, 248, 33/249; 350/10; 356/254, 255

[56] References Cited

U.S. PATENT DOCUMENTS

| | | | |
|---|---|---|---|
| 2,054,090 | 9/1936 | Marple | 33/245 |
| 2,225,037 | 12/1940 | Dake | 33/245 |
| 3,875,675 | 4/1975 | Krisay | 33/245 |

FOREIGN PATENT DOCUMENTS

| | | | |
|---|---|---|---|
| 177,911 | 11/1906 | Germany | 350/10 |

*Primary Examiner*—Richard E. Aegerter
*Assistant Examiner*—Richard R. Stearns
*Attorney, Agent, or Firm*—Warren F. B. Lindsley

[57] ABSTRACT

A mechanical-optical gun sight mountable on a firearm for permitting the user to bring the weapon into general alignment first through the iron sights of the weapon and then sequentially opening an optical system to transport a telescopic "cross hair" image of the target into the user's same line of sight and reverting back to the iron sight upon discharging of the weapon.

9 Claims, 11 Drawing Figures

GUN SIGHT

BACKGROUND OF THE INVENTION

This invention relates to gun sights and more particularly to a mechanical-optical gun sight mountable on a firearm which permits the user to bring the weapon into firing position in the direction of the target with the use of the weapon's "iron sights" and then upon a slight movement of its trigger expose a reflective surface transporting a telescopic "cross hair" image of the target into the user's same line of sight allowing considerably more accurate aiming of the weapon. Upon discharge of the weapon the optical system portion of the gun sight is released causing the gun sight to revert back to its iron sight mode of use.

This invention is particularly directed to a mutually complimentary marriage of the iron sights of a gun with an optical system making it possible to employ the benefits of each to accomplish a swift and accurate zeroing in on the target without the usual time necessary with the optical system only for searching for the target.

DESCRIPTION OF THE PRIOR ART

Toy guns have been provided with built in sighting systems activated by a trigger of the gun such as that shown and described in U.S. Pat. No. 3,441,270. However, these devices merely employ a stationary mirror normally reflecting one of several small targets onto a second reflecting surface of a movable mirror. During aiming of the toy gun, the image is reflected through an eyepiece. The movable mirror is mechanically linked to the trigger of the toy gun such that pulling of the trigger pivots the mirror out of the line of sight, thereby optically eliminating the reflected target figure simulating destruction of the target. There is no teaching of a combination of the iron sights and an optical system for weapon use utilizing the benefits of both types of sights and eliminating the short comings of each.

U.S. Pat. No. 3,875,675 discloses a scope mounting base for supporting attachable and detachable scope clamping and mounting rings such as are currently being used to accurately and reliably support a conventional scope atop the barrel of a supporting rifle. This scope mounting base employs a telescope mounting adaptor which holds a telescope such that fixed iron sights may be used in one line of sight and then the telescopic sight used but in a different line of sight.

U.S. Pat. No. 3,835,565 discloses a mounting for supporting a telescopic sight on a base plate. The mounting employs a pair of spaced walls with grooves mating with the side edges of the base plate such that the user can view the iron sights along a line of sight passing between the spaced walls.

SUMMARY OF THE INVENTION

In accordance with the invention claimed, a new and improved gun sight is provided employing multiple mode sighting for utilizing sequentially the iron sight of the weapon and its telescopic sight, employing the desirable features of each and eliminating their undesirable features.

Accordingly, it is one object of this invention to provide a new and improved gun sight.

Another object of this invention is to provide a new and improved gun sight which allows the shooter to get on target quickly with open iron sights, then mechanically switches to an optical telescopic sight along the same line of sight.

A further object of this invention is to provide an improved gun sight wherein the trigger of the gun upon a predetermined movement causes the cross hair telescopic image to appear in the same line of sight as the iron sights.

A still further object of this invention is to provide a new and improved gun sight wherein a predetermined movement of a trigger of the weapon superimposes the cross hairs of a telescopic sight on the iron sight target image.

A still further object of this invention is to provide a dual sighting device which uses a common line of sight.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
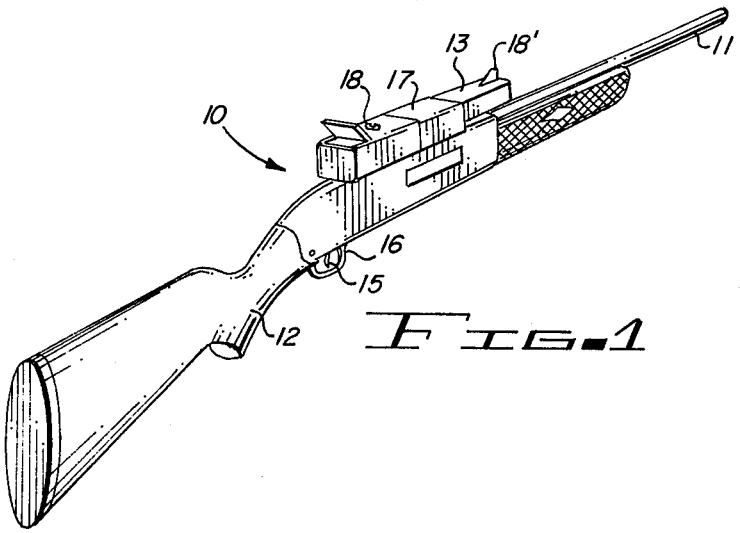
FIG. 1 is a perspective view of a rifle embodying a gun sight employing the invention.
Figure 2:
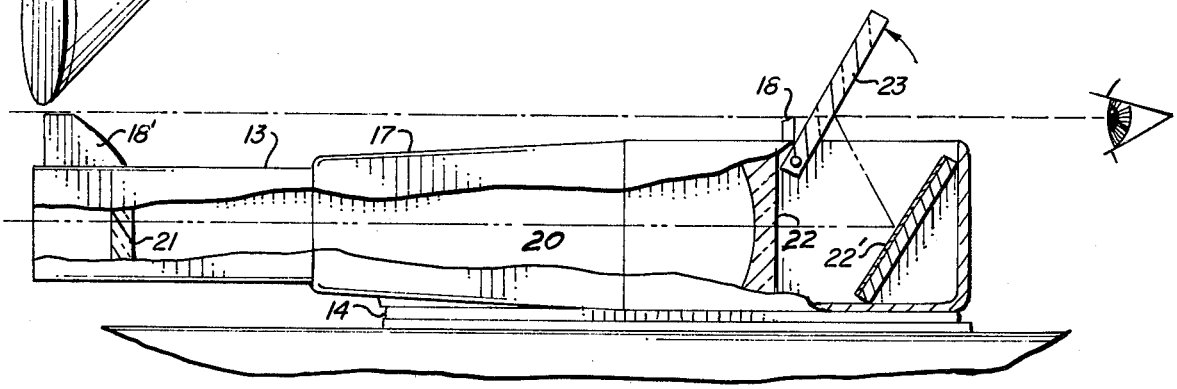
FIG. 2 is a enlarged partial view of the gun sight shown in FIG. 1 with parts broken away for purposes of illustration.
Figure 3:
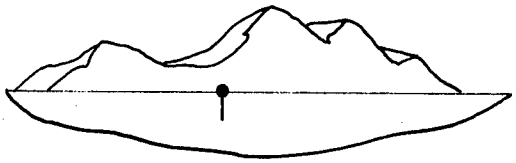
FIG. 3 is a view of an item, identified by the shooter as the target.

Referring more particularly to the drawing by characters of reference, FIGS. 1 and 2 disclose conventional rifle 10 having an elongated barrel 11 and stock 12. A novel gun sight 13 is supported by suitable mounting means 14 on the receiving portion of the barrel. Since any suitable mounting means may be used details thereof have been omitted for reasons of clarity. The gun further comprises a trigger 15 enclosed within a typical trigger housing 16, which trigger is linked, as will be described, to various portions of the novel gun sight.

The gun sight 13 comprises a housing 17 having iron sights 18, 18' mounted at the upstream and downstream ends thereof which replace the conventional iron sights on the barrel of the gun but fully simulating their function.

Within housing 17 is mounted a telescopic sighting device 20 which may comprise, for example, a pair of lenses 21 and 22 and a stationary reflective member 22'.

A hingedly mounted reflective member 23, which may have transparent characteristics, is mounted on housing 17 for selective movement from within or adjacent the housing into the line of sight through the iron sights of the weapon as shown in FIG. 2. It should be noted that member 22 may be slidably mounted in housing 17 and fall within the scope of this invention. Member 23 may be provided with the usual "cross hairs" 24, 24' of a telescopic sight. Thus, when member 23 is moved into the line of sight through the iron sights the telescopic cross hairs 24, 24' are superimposed on the iron sights in the same line of sights through the iron sights.

Figure 4:
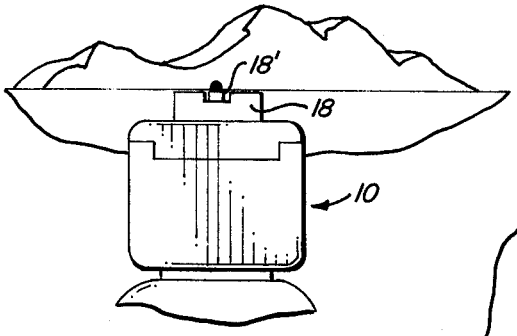
FIG. 4 is a view of the target shown in FIG. 3 as viewed through the disclosed gun sight in mode 1 of its sighting procedure.

Prior to the movement of the movable member 23, into the line of sight, the user of the weapon utilizes the iron sights of the weapon as shown in FIG. 4. Thus, the weapon is brought into firing position initially in mode 1 of its use by use in the well known manner of the iron sights.

Figure 5:
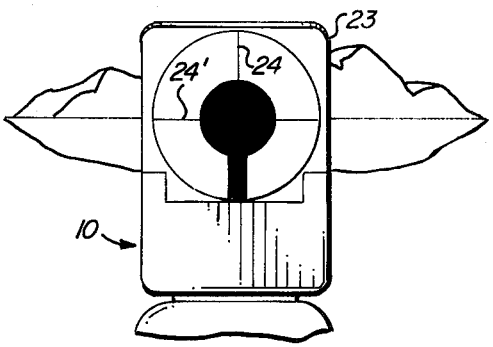
FIG. 5 is a view of the target shown in FIG. 3 as viewed through the disclosed gun sight in mode 2 of its sighting procedure.

At this point, trigger 15, which is pivoted on the frame of the gun and spring connected thereto in the usual manner, may be pulled by the user. This action sets in motion a sequence of mechanically linked operations which leads to the actuation of the movable member 23 out of or adjacent housing 17 into the line of sight of the iron sights of the weapon as shown in FIG. 5.

Figure 6:
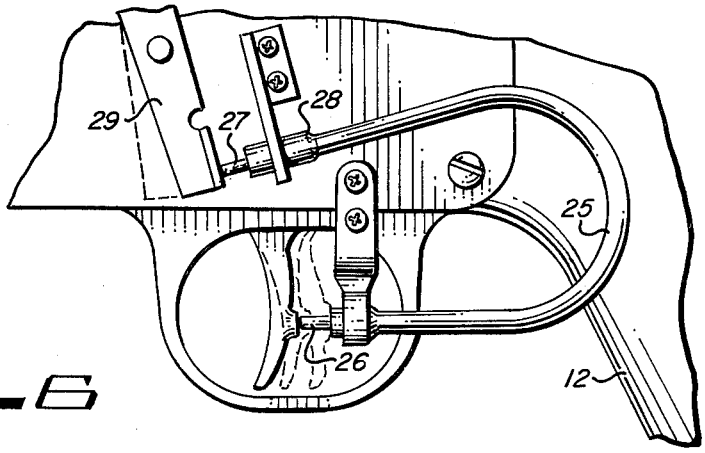
FIG. 6 is an enlarged partial side view of the triggering mechanism of the disclosed gun sight.

The trigger 15 of the weapon is linked by a spring (not shown) to an angular push arm of flexible cable 25, as shown in FIG. 6, which bears a projecting stud 26 at its trigger engaging end. The initial pressure on the trigger in a pulling operation causes movement of the stud 27 on other end 28 of the flexible cable fixedly mounted on the frame adjacent a cam member 29 pivotally on the frame of the weapon.

Cam member 29 bears against a bifurcated push arm 30 pivoted in housing 17. This push arm is biased by a tension spring 31 extending between a point thereon and the housing against a stop 32.

A strike plate 33 pivotally mounted in housing 17 is biased by a leaf spring 34 to one of two over center positions. This striker plate carries a bifurcated arm 35 fixedly attached thereto. The bifurcated slot 36 at the end of arm 35 surrounds a stud 37 projecting outwardly of member 23 which holds the pivotally mounted member 23 as shown. Rotation of the push arm causes a corresponding rotation of the member 23. Since the leaf spring 34 biases and holds striker plate 33 in one of two positions the movement of arm 35 either places the member 23 in the line of sight of the user as shown in FIG. 7 or out of the line of sight in housing 17.

Accordingly, the normal aiming and firing sequence is utilized through the iron sights of the weapon but upon limited movement of the trigger 17 of the weapon controlled movement of member 23 occurs causing member 23 and the telescopic target image to be moved into the direct line of sight through the iron sights of the weapon. Thus, only one line of sight through the weapon is utilized but two sighting systems or modes of operation are sequentially used.

Figure 7:
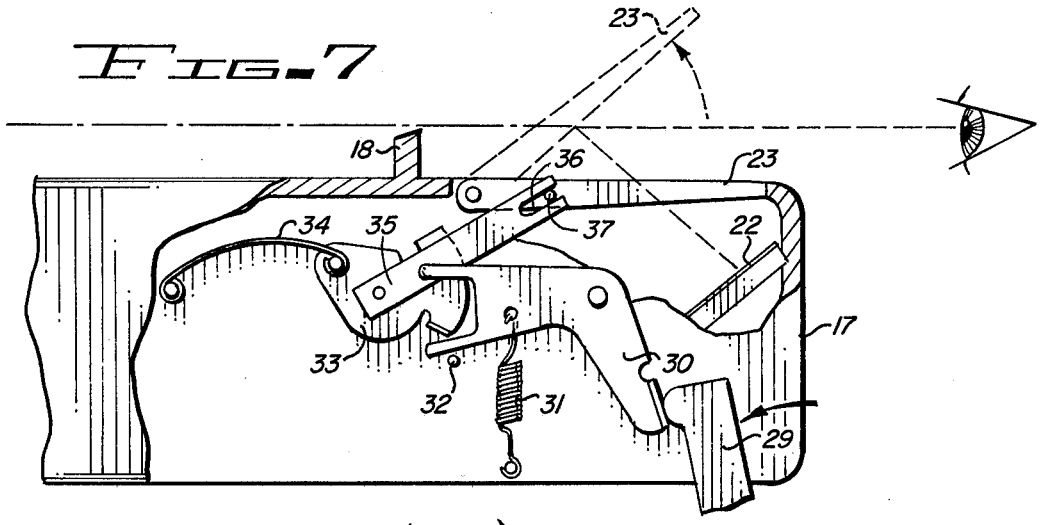
FIG. 7 is an enlarged partial side view of a second portion of the triggering mechanism shown in FIG. 6 illustrating the positioning of the movable reflective surface in the line of sight through the iron sights of the gun and its over center spring loaded striker arm.
Figure 8:
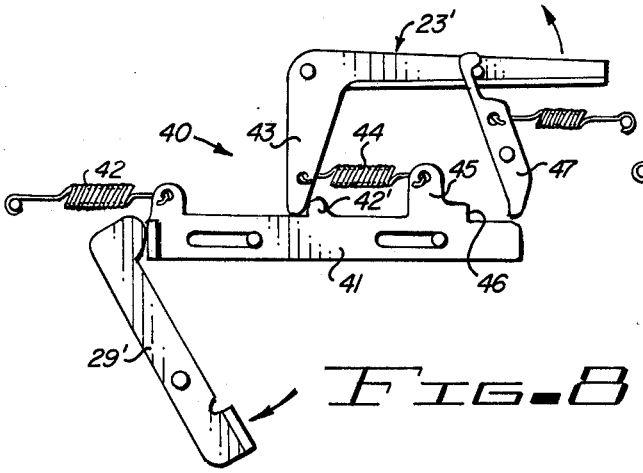
FIG. 8 is a side view of a modification of the triggering mechanism shown in FIG. 7 illustrating an optical system quick reflective surface release mechanism.

FIG. 8 discloses a modification of the triggering mechanism of the optical system shown in FIGS. 1–7 wherein a modified form of the cam member 29 of FIGS. 6 and 7 is utilized in combination with a spring tensioning release mechanism 40. Cam member 29' bears directly against a slide plate 41 mounted in housing 17 which is biased by tension spring 42, as shown in FIG. 8 to the left, in a direction to cause member 23' to be pivoted to its out of "line of sight" position shown.

The slide plate 41 has a cam surface 42' against which an arm 43 of member 23' bears under the spring tension of spring 44. Tension spring 44 is connected between arm 43 and an arm 45 of slide plate 41, as shown. A striking surface 46 of slide arm 41 when moved to the right as shown in FIG. 8 engages a spring biased lever arm 47 to release member 23' for limited movement to its line of sight position through the iron sights of the weapon.

Figure 9:
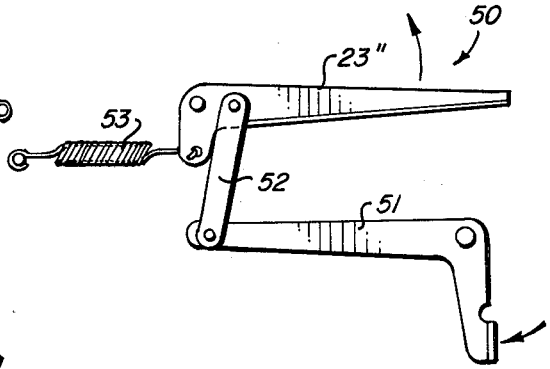
FIG. 9 illustrates a further modification of the release mechanism shown in FIGS. 7 and 8 employing a direct mechanical connection to the reflective surface.

FIG. 9 discloses a further modification of the triggering mechanism of the gun sight disclosed, wherein the mechanical linkage system 50 disclosed comprises a link 51 pivotally mounted in housing 17 which is engaged by a cam member 29 at one end, as shown in FIG. 7. The other end of link 51 is pivotally connected by a link 52 to member 23''. Member 23'' is pivotally mounted on housing 17 and spring biased to its out of sight position by a tension spring 53, as shown.

Figure 10:
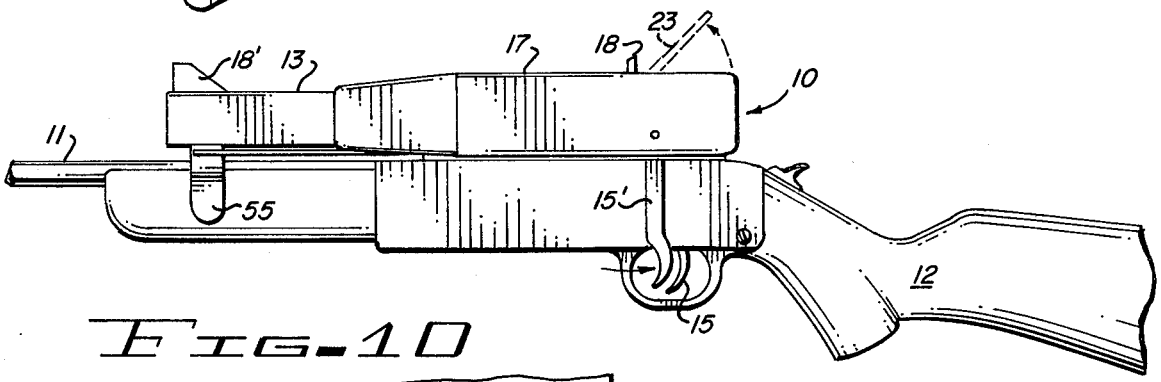
FIG. 10 is a partial side view of a gun illustrating a separate trigger for the gun sight.
Figure 11:
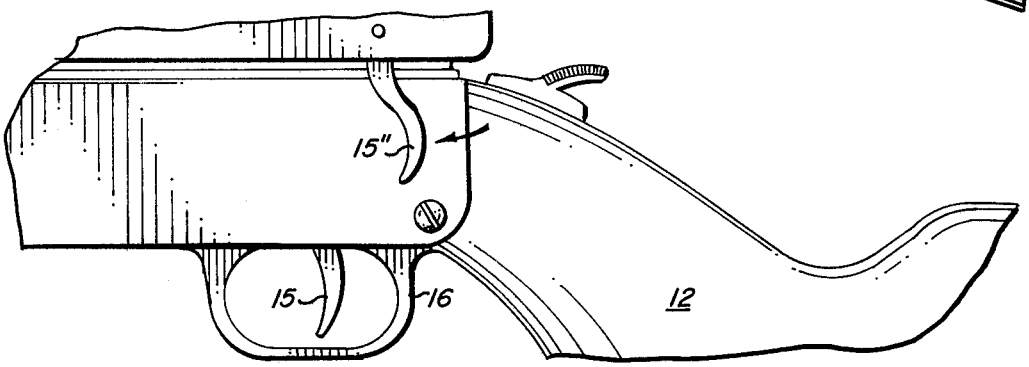
FIG. 11 is a partial view of a gun illustrating a thumb operated release mechanism for the gun.

It should be noted that the gun sight mechanisms of FIGS. 1–9 utilize trigger 17 of the weapon to actuate the optical system of the weapon. FIGS. 10 and 11 disclose modifications of the systems differing merely in the provisions of a separate trigger 15' and 15'' for the optical system.

In FIG. 10, trigger 15' is pivotally mounted on housing 17 and has a cam surface that bears against cam members 29, 29' or link 51 of the mechanism disclosed for actuating the optical system of the gun sight.

If desired a forestock lever 55 may be used for triggering the operation by one thumb of the user. This lever 55 may be pivotally or slidably mounted on housing 17 for limited movement, which movement actuates cam members 29, 29' or link 51 as heretofore explained or any other simplifed version thereof.

FIG. 11 discloses a means of positioning the thumb release of the optical system of the gun sight at a position spaced from the trigger 15 of the weapon. This trigger 15'' operates to actuate the optical system of the gun sight in the same manner as described for FIGS. 1–9 of the drawing.

Thus, a novel reflex sighting system has been disclosed employing a mechanical-optical aiming device which is mountable on any firearm which must be aimed and fired quickly and accurately.

The shooter brings the weapon into firing position in the direction of the target. Then aims through the iron sights to bring the weapon into general alignment (mode 1). Then activates the device in mode 2 of the sighting sequence which opens the reflex member transporting a telescopic "cross hair" image of the target into the shooter's same line of sight, allowing considerably more accurate aiming. Upon discharging of the weapon, the activating means can be released, allowing the member 23 to move back to housing 17 and the sight system to revert back to mode 1 of the weapon's gun sighting sequence.

This sighting system allows aiming with the tremendous advantage of an optically enlarged image with cross hairs without having to take the time to search for the target because of the limited field of view. This reflex system allows the shooter to "get on target" quickly with open iron sights, then mechanically switch images allowing the use of the most efficient sight picture when it is most effective.

It should be recognized that member 23 may be a reflective, transparent or partially transparent member as well as a mirror. Member 23 may also be formed of a transparent, reflective surface having a mirror surface as a part thereof such as its center section for receiving at that point a partial portion of the telescopic image.

While the principles of the invention have now been made clear in illustrative embodiments, there will be many obvious modifications of the structure, proportions, material and components without departing from those principles. The appended claims are intended to cover any such modifications.

What is claimed is:

1. A sight mechanism for a weapon having a barrel, said mechanism comprising:

an elongated housing for mounting on a gun, a telescopic sight mounted in said housing for receiving said target image through a given line of sight, said telescopic sight having a first reflective means for reflecting said target image from said given line of sight to intersect another line of sight, a second reflective means mounted on said housing for selective movement to a first position out of said another line of sight, and to a second position to receive the reflected target image and to direct it along said another line of sight, and means for selectively moving said second reflective means into said first and second positions said means for selectively moving said second reflective means being actuated to move said second reflective means to said second position by pulling a trigger arried by the gun, and being actuated to return said second reflective means to said first position upon release of the trigger.

2. The sight mechanism set forth in claim 1 wherein:

line of sight is generally parallel to said given line of sight, whereby said second reflective means in said second position replaces said target image on an image of the target viewed through said another line of sight.

3. The sight mechanism set forth in claim 1 wherein:

second said reflective means is partially transparent.

4. The sight mechanism set forth in claim 1 wherein:

said second reflective means comprises a mirror.

5. The sight mechanism set forth in claim 1 wherein:

said second reflective means is pivotally mounted on said housing.

6. A sighting mechanism for a gun comprising:

an elongated housing for mounting on a barrel of a gun longitudinally thereof, a pair of iron sights one mounted at each end of said housing for presenting a target image therethrough in a first line of sight, a telescopic sight mounted in said housing parallel with said iron sights for receiving and enlarging at least a part of said target image through a second line of sight, said telescopic sight having a first reflective means for reflecting said target image from said first line of sight to intersect with said second line of sight, a second reflective means movable from a first position out of said first line of sight to a second position for receiving said target image from said first reflective means of the telescopic sight and to direct it along said first line of sight, and means for selectingly moving said second reflective means into said first and second positions.

7. The sighting mechanism set forth in claim 6 wherein:

said second reflective means is pivotally mounted on said housing.

8. The sighting mechanism set forth in claim 6 wherein:

said moving means is actuated by a trigger carried by the gun.

9. The sighting mechanism set forth in claim 6 wherein:

said moving means comprises the trigger means of the gun which is spring biased normally to its non gun firing position, said moving means further comprising linkage means for causing said second reflective means to return to its first position by the action of the trigger means returning to its non gun firing position.

* * * * *

UNITED STATES PATENT OFFICE

CERTIFICATE OF CORRECTION

Patent No. 4,084,326 Dated April 18, 1978

Inventor(s) Jody L. Numbers

It is certified that error appears in the above-identified patent and that said Letters Patent are hereby corrected as shown below:

Claim 1, line 15, after "positions" add ---,---.

Claim 1, line 19, after "trigger" cancel "arried" and substitute ---carried---.

Claim 2, line 2, before "line" (first occurence) add ---said another---.

Claim 6, line 19, after "for" cancel "selectingly" and substitute ---selectively---.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*